US005437215A

United States Patent [19]

Hamilton

[11] Patent Number: 5,437,215

[45] Date of Patent: Aug. 1, 1995

[54] ULTRASONIC CUTTING DEVICE

[75] Inventor: Francis F. Hamilton, Leicester, Great Britain

[73] Assignee: Nestec S.A., Vevey, Switzerland

[21] Appl. No.: 105,374

[22] Filed: Aug. 11, 1993

[30] Foreign Application Priority Data

Aug. 28, 1992 [GB] United Kingdom ..... 9218354

[51] Int. Cl.[6] ..... B26D 1/45; B26D 7/08

[52] U.S. Cl. ..... 83/701; 83/956

[58] Field of Search ..... 83/13, 56, 701, 956; 51/59 SS; 74/1 SS

[56] References Cited

U.S. PATENT DOCUMENTS

| | | | |
|---|---|---|---|
| 2,813,377 | 11/1957 | Duran | 51/59 SS |
| 3,031,804 | 5/1962 | Thatcher et al. . | |
| 3,416,398 | 12/1968 | Bodine, Jr. | 83/523 |
| 3,471,724 | 10/1969 | Balamuth . | |
| 3,742,796 | 7/1973 | McMillan | 83/102.1 |
| 5,226,343 | 7/1993 | Rawson et al. | 83/508.3 |
| 5,228,372 | 7/1993 | Harrop et al. | 83/13 |

FOREIGN PATENT DOCUMENTS

| | | | |
|---|---|---|---|
| 2219245 | 12/1989 | United Kingdom | 83/701 |
| 923804 | 5/1982 | U.S.S.R. . | |

*Primary Examiner*—Eugenia Jones
*Attorney, Agent, or Firm*—Vogt & O'Donnell

[57] ABSTRACT

An ultrasonic cutting device includes a transducer, an ultrasonic horn and a cutting blade. The transducer generates ultrasonic vibrations in a direction having a longitudinal axis, and the ultrasonic horn has a nodal point and at least three projections extending, respectively, to vibrating faces equidistantly away from and symmetrically about the nodal point, one of the vibrating faces being connected to the transducer so that, in operation, the ultrasonic horn is vibrated. The cutting blade is connected to one of the vibrating faces of the ultrasonic horn which is not connected to the transducer and is positioned in a plane transverse to the longitudinal axis of vibrations so that, in operation, the blade is vibrated.

11 Claims, 3 Drawing Sheets

FIG. 1
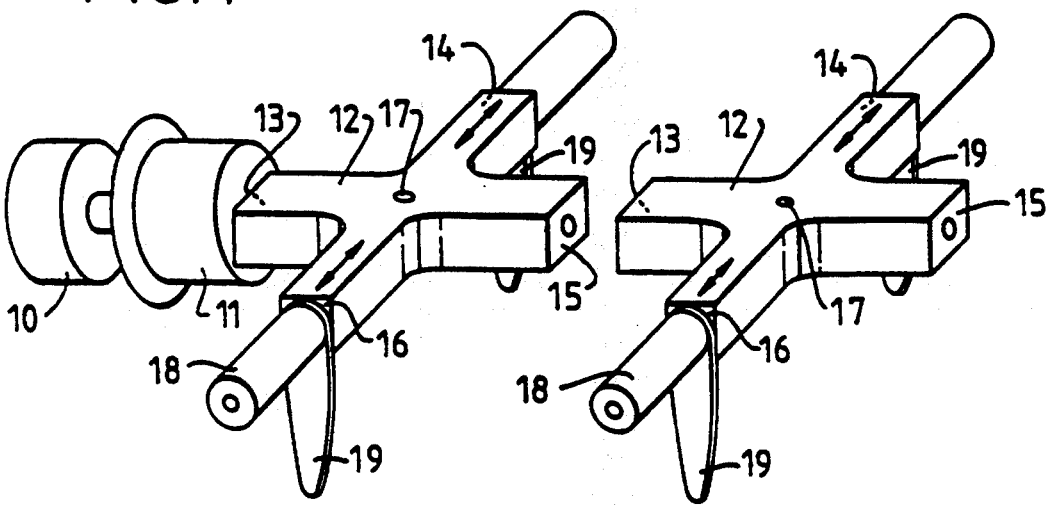
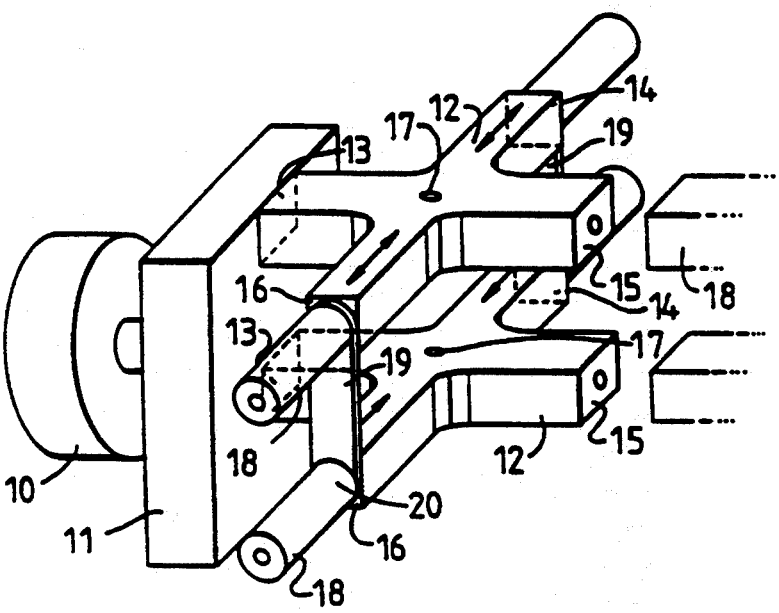
FIG. 2
FIG. 8
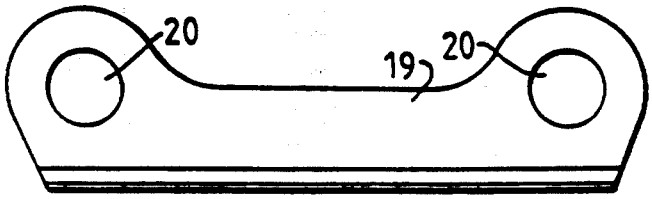

FIG.3
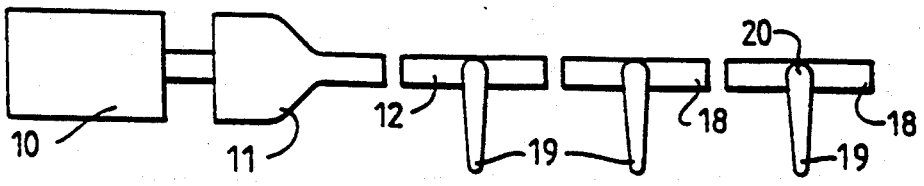
FIG.4
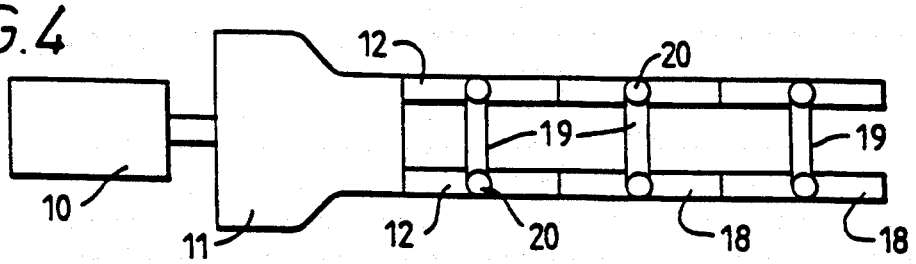
FIG.5
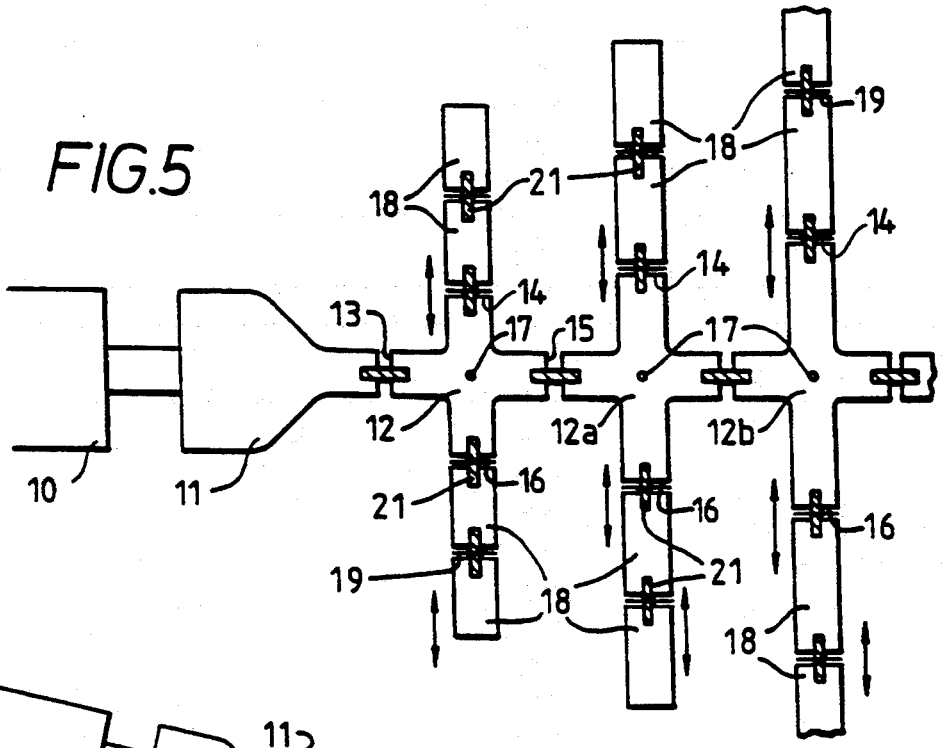
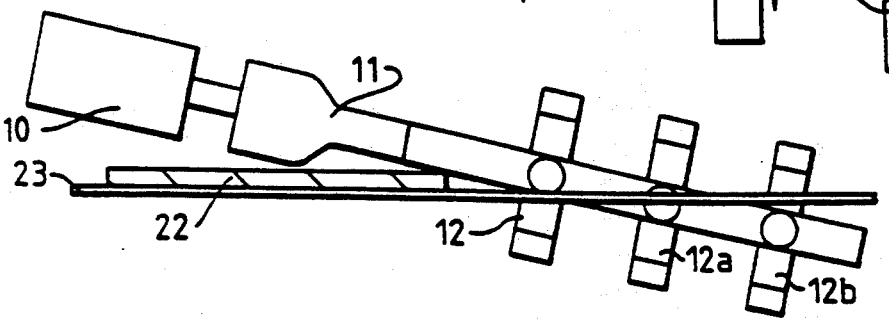
FIG.6
FIG.7
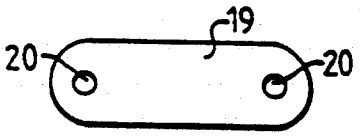

ULTRASONIC CUTTING DEVICE

This invention is concerned with improvements relating to cutting, particularly by a method involving the use of high frequency (ultrasonic) vibration devices.

The conventional method of ultrasonic cutting involves the use of a cutting blade which is mounted on an ultrasonic vibrating device with the blade lying in a plane containing the longitudinal axis of vibrations, and moving the blade through the article to be cut in said plane.

Difficulty is experienced using conventional methods in that the depth of cut which is attainable is limited. For this reason ultrasonic cutting has in general been limited to thin articles, such as paper, cloth and thin plastic sheets. A significant problem exists in cutting blocks of substantial depth, and/or in providing a number of parallel cuts simultaneously.

Difficulty is also experienced in cutting materials which are brittle or friable, e.g., honeycomb or crystalline materials which may shatter if dropped.

European Patent Application No. 89109488.0 describes a method and apparatus for cutting an article involving mounting a cutting blade on an ultrasonic vibrating device in a manner such that the blade lies in a plane extending transverse (preferably at right angles) to the longitudinal axis of vibrations, and moving said blade in said plane through said article.

In this manner the blade moves back and forth, transverse to the plane in which it moves through the article, effecting a removal of the material of the article along the line of cut. The blade vibrates in a complex vibrational mode determined by the blade dimensions.

The vibrating device comprises basically a vibrating mechanism in the form of a horn, usually rod shaped, the front face of which is caused to vibrate at ultrasonic frequency by a source of ultrasonic power, e.g., a transducer producing sinusoidal motion secured to the rear of the horn either directly or indirectly through a booster device. The ultrasonic horn generates the ultrasonic vibrations in a direction having a longitudinal axis in which the maximum vibration occurs at each end, i.e., the front face and the rear face which form the antinodes at a quarter wavelength from a node which is stationary in space and which is positioned at a point half way between the antinodes. Usually, the length of an ultrasonic horn is well defined as half the wavelength.

In one embodiment of the invention described in the above-noted European Patent Application the vibrating device comprises one or more support mebers secured to the ultrasonic horn, which are vibrated by the ultrasonic horn, each support member supporting a plurality of blades each blade secured at an antionode where they are caused to vibrate.

SUMMARY OF THE INVENTION

It has now been found that ultrasonic horns with more than two vibrating faces or antinodes may also be employed, wherein each blade is supported at a vibrating face and lies in a plane extending transverse (preferably at right angles) to the axis of vibrations.

Accordingly, the present invention provides a cutting device comprising an ultrasonic vibrating device and a cutting blade mounted on the device so as to be vibrated thereby, the blade lying in a plane transverse to the axis of vibration characterised in that the ultrasonic vibrating device comprises an ultrasonic horn having more than two projections arranged symmetrically around the nodal point, each projection having a vibrating face at a distance of a quarter wavelength from the nodal point, one of the vibrating faces being secured to a transducer either directly or indirectly.

The present invention also provides a method of cutting an article involving mounting a cutting blade on an ultrasonic vibrating device in a manner such that the blade lies in a plane extending transverse to the longitudinal axis of vibrations, and moving said blade in said plane through said article, wherein the ultrasonic vibrating device comprises an ultrasonic horn having more than two projections arranged symmetrically around the nodal point, each projection having a vibrating face at a distance of a quarter wavelength from the nodal point, one of the vibrating faces being secured to a transducer either directly or indirectly.

DETAILED DESCRIPTION OF THE INVENTION

When one of the vibrating faces of the ultrasonic horn is secured to the transducer indirectly, this may be through a booster device, which adds "gain" or "increased amplitude of vibration", or through a rod-shaped ultrasonic horn, which has a vibrating face at each end, one of which is secured to the transducer.

As used herein, a "horn" (also known as a sonotrode) is a resonant ultrasonic device, usually a single half wavelength made of a suitable metal, e.g., a low density alloy of aluminum or titanium. The cross-section may be, for instance, circular or rectangular. Hereinafter, "ultrasonic horn having more than two projections arranged symmetrically around the "nodal point" will be referred to as "ultrasonic horn" and "rod shaped ultrasonic horn" will be referred to as "rod shaped horn". The vibrating faces of the ultrasonic horn are equidistant from the single nodal point of the ultrasonic horn.

The number of projections of the ultrasonic horn is only limited by practical considerations. There may be, for instance, up to 20 projections. More commonly, the ultrasonic horn has 3, 4, 6 or 8 projections, those with 3 projections being roughly Y-shaped, and those with 6 and 8 projections being roughly star-shaped. Especially advantageous is a cruciform-shaped ultrasonic horn with 4 projections. When the transducer is secured to the face of one of the projections, or one end of a rod-shaped horn, it causes the ultrasonic or rod-shaped horn to vibrate, the maximum vibration occurring at the faces of the projections or at the opposite end of the rod-shaped horn.

The blades may be attached at an antinode to one or more of the vibrating faces of the ultrasonic or rod-shaped horn (other than the face secured to the transducer), where they are caused to vibrate. Advantageously, one or more further rod shaped horns, or one- or more further ultrasonic horns, are secured to one or more vibrating faces of the ultrasonic or rod-shaped horn secured to the transducer, each further rod-shaped horn or further ultrasonic horn supporting one or more blades, each of which is secured at an antinode where they are caused to vibrate. The rod-shaped horns have a vibrating face at each end and the ultrasonic horns may be shaped to have more than two projections arranged symmetrically around the nodal point, each projection having a vibrating face at a distance of a quarter wavelength from the nodal point.

Some at least of the ultrasonic or rod-shaped horns may be provided with a shape factor by means of node-/antinode displacement devices, e.g., of the type having reduced mass or added mass, to displace the position of the antinodes in a direction towards or away from, respectively, the vibrating face of the ultrasonic or rod-shaped horn to which they are secured. The displacement of the position of the antinodes alters the blade spacing whereby, when the device has multiple blades, the blades are staggered so that an article may be cut simultaneously by a plurality of cut lines.

Advantageously, there may be two ultrasonic or rod-shaped horns secured to the transducer (either directly or indirectly through a booster device) parallel to one another so that each blade may be supported by the adjacent vibrating faces of the two ultrasonic or rod-shaped horns, the blade advantageously being secured at each of its respective ends. Such a device with a double-drive has more cutting power than a single-drive device where only one ultrasonic or rod-shaped horn is secured to the transducer. In this embodiment one or more further pairs of parallel rod-shaped horns, or one or more further pairs of parallel ultrasonic horns, each supporting one or more blades, may advantageously be secured to one or more pairs of parallel vibrating faces of each of the two parallel ultrasonic or rod-shaped horns secured to the transducer, with one or more blades being secured at each of their respective ends to the antinodes of a pair of ultrasonic or rod-shaped horns at adjacent parallel vibrating faces. Each blade lies, respectively, in one of a plurality of parallel planes.

The number of rod-shaped horns or ultrasonic horns is only limited by practical considerations and there may be, for instance, up to 20 of either.

The antinode is the crest of a sinusoidal oscillation, hence, as used herein, an antinode shall be understood as meaning one quarter wavelength +10% from the node, the node being a stationary point where there is no vibration, preferably one quarter wavelength +5%, more preferably +2%, even more preferably +1% from the node and most preferably at the true antinodal point i.e. one quarter wavelength from the node.

The ultrasonic horn and the rod-shaped horns are desirably made of high fatigue strength aluminium or titanium alloys. The ultrasonic horn may be machined from a bar and the horn and the support members may be joined, for instance, by means of grub screws.

The blades are conveniently made of hard, tough or flexible materials, e.g., steel, graphite-impregnated steel, tempered high tensile steel, flexible ceramics such as zirconium types or fibre reinforced composites. They could be coated with non-stick and/or hard wearing non-abrasive coatings such as chrome, polytetrafluoroethylene or flexible ceramics or by other surface-hardening treatments. The cutting edge of the blade may be spark-eroded or otherwise cut to produce a hollow edge.

The blades may be wide, narrow, thin or they may be wires. They may be round, triangular or roughly square in shape, but they are preferably rectangular, e.g., from 10 to 100 mm long and from 1 to 22 mm wide. When the blades are roughly square or rectangular in shape, they are advantageously profiled so that they are narrower along a portion of their lengths than at their ends. For example, from 40% to 90% and preferably from 50% to 70% of their length between the ends is narrower and the width may be up to 60% less than at the ends. The thickness of the blades may be from 0.25 to 1.5 mm and more usually from 0.5 to 1.35 mm, especially from 0.85 to 1.2 mm. A blade which is driven at each end is usually provided with an aperture at each end.

In the cutting method of the invention, the movement of the blade relative to the article to be cut may, if desired, be achieved by moving the article through the blade. However, it is also possible to move the blade through the article to be cut.

The frequency used may be within the audio range of from 5 to 15 KHz, but is preferably between 15 and 100 KHz, especially from 20 to 40 KHz.

BRIEF DESCRIPTION OF THE DRAWINGS

The present invention is further illustrated by way of example only with reference to the accompanying drawings.

FIG. 1 represents a diagrammatic perspective view of a single-drive cutting device according to the invention.

FIG. 2 represents a diagrammatic perspective partly exploded view of a double-drive cutting device according to the invention.

FIG. 3 represents a side view of a single drive cutting device of the invention.

FIG. 4 represents a side view of a double drive cutting device of the invention.

FIG. 5 represents a plan view of a single or double-drive cutting device according to the invention, two of the horns having a shape factor to stagger the blades.

FIG. 6 represents a side view of the cutting device of FIG. 5.

FIGS. 7 and 8 are views of a blade driven at each end as in FIGS. 2 and 4.

DETAILED DESCRIPTION OF THE DRAWINGS

Figure 9:
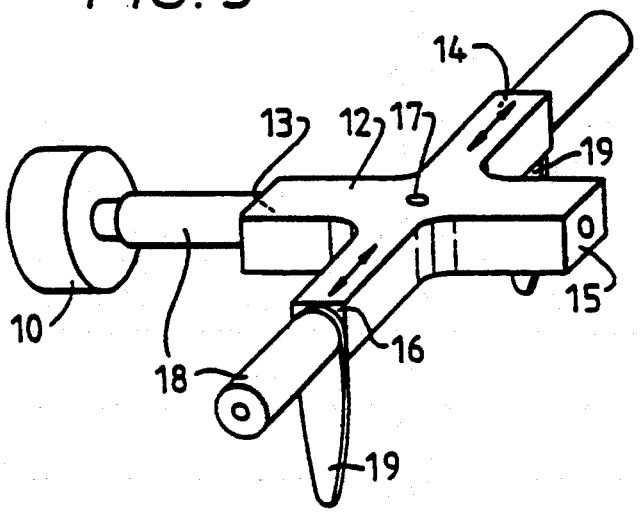
FIG. 9 represents an ultrasonic cutting device of the invention in which the ultrasonic horn is connected to a rod-shaped horn connected to the transducer.

Referring to the drawings, as illustrated in FIGS. 1–4, the cutting device comprises a transducer 10, booster 11 (or rod-shaped horn 18 in FIG. 9, cruciform shaped ultrasonic horns 12, having four vibrating faces 13, 14, 15, 16 at antinodes one quarter wavelength from the nodal point 17 (the wavelength is approximately 240 mm for a 20 kHz horn in aluminium alloy), rod-shaped horns 18, and blades 19. Blades which are driven at each end, as illustrated in FIGS. 2, 4 and 7, are provided with apertures 20 and are connected to the antinodes by an internal stud fastening 21 which passes through the apertures 20. In FIG. 5, the ultrasonic horns **12*a* and 12*b* have a shape factor whereby the antinodal vibrating faces 14 and 16 of horn 12*b* are offset from those of horn 12 and the antinodal vibrating faces 14 and 16 of horn 12 are offset from those of horn 12*a*** in order to stagger the blades which are positioned at the displaced antinodes.

The cutting blades lie in a plane at right angles to the axis of the vibrations. The blade of FIG. 7 is 1 mm thick, 15 mm wide and 90 mm long, while the blade of FIG. 8 is 1 mm thick, 87 mm long, the largest width is 24 mm, the narrowest width is 8 mm and the diameter of the apertures is 10.5 mm.

In operation, the transducer 10, aided by the booster device 11, produces ultrasonic power, causing the faces 13, 14, 15 and 16 of the ultrasonic horns to vibrate at 20 KHz which cause the blades 19 to vibrate in the direction of the arrows shown in FIGS. 1, 2 and 5 as they pass to the right through the wafer biscuit 22 supported on the table 23 to excavate several cuts simultaneously. The angle of the cutting device shown in FIG. 6 enables the biscuit 22 to pass beneath the transducer, the booster and the cruciform horn 12.

The ultrasonic cutting device of the invention enables easy blade changes and also enables self feed phenomena, whereby the material to be cut will feed itself into the device where there are maximum vibrations at the antinodes.

Materials which may be cut by this device include metal, stone, plastics, confectionery, chocolate, food, pharmaceutical, cosmetics, paper and cardboard. The device is particularly useful for brittle or friable materials of any thickness and may be used to cut frozen food products.

I claim:

1. An ultrasonic cutting device comprising:

a transducer which, in operation, generates ultrasonic vibrations in a direction having a longitudinal axis;

a first ultrasonic horn having a nodal point and at least three projections extending, respectively, equidistantly away from and symmetrically about the nodal point, each projection having a vibrating face one quarter wavelength away from the nodal point, one of the vibrating faces being connected to the transducer so that, in operation, the ultrasonic horn is vibrated; and a first cutting blade connected to one of the vibrating faces of the ultrasonic horn which is not connected to the transducer, the cutting blade being positioned in a plane transverse to the longitudinal axis of vibrations generated by the transducer so that, in operation, the blade is vibrated.

2. An ultrasonic cutting device comprising:

a transducer which, in operation, generates ultrasonic vibrations in a direction having a longitudinal axis;

a first ultrasonic horn having a nodal point and at least three projections extending, respectively, equidistantly away from and symmetrically about the nodal point, each projection having a vibrating face one quarter wavelength away from the nodal point;

a booster device connected to the transducer, and to one of the vibrating faces of the ultrasonic horn, so that, in operation, the ultrasonic horn is vibrated; and a first cutting blade connected to one of the vibrating faces of the ultrasonic horn which is not connected to the booster device, the cutting blade being positioned in a plane transverse to the longitudinal axis of vibrations generated by the transducer so that, in operation, the blade is vibrated.

3. An ultrasonic cutting device comprising:

a transducer which, in operation, generates ultrasonic vibrations in a direction having a longitudinal axis;

a first ultrasonic horn having a nodal point and at least three projections extending, respectively, equidistantly away from and symmetrically about the nodal point, each projection having a vibrating face one quarter wavelength away from the nodal point;

a first rod-shaped horn having vibrating ends connected, respectively, to the transducer and to one of the vibrating faces of the ultrasonic horn so that, in operation, the ultrasonic horn is vibrated; and a first cutting blade connected to one of the vibrating faces of the ultrasonic horn which is not connected to the rod-shaped horn, the cutting blade being positioned in a plane transverse to the longitudinal axis of vibrations generated by the transducer so that, in operation, the blade is vibrated.

4. An ultrasonic cutting device according to claim 1, 2 or 3 further comprising a second ultrasonic horn, identical to the first ultrasonic horn, and a second cutting blade, wherein the second ultrasonic horn is connected to the first ultrasonic horn through respective vibrating faces and wherein the second cutting blade is connected to one of the vibrating faces of the second ultrasonic horn which is not connected to the first ultrasonic horn and is positioned in a plane transverse to the longitudinal axis of vibrations generated by the transducer.

5. An ultrasonic cutting device according to claim 1 or 2 further comprising a rod-shaped horn having vibrating ends, and a second cutting blade, wherein one of the vibrating ends of the rod-shaped horn is connected to one of the vibrating faces of the ultrasonic horn and wherein the second cutting blade is connected to the vibrating end of the rod-shaped horn which is not connected to the ultrasonic horn and is positioned in a plane transverse to the longitudinal axis of vibrations generated by the transducer.

6. An ultrasonic device according to claim 3 further comprising a second rod-shaped horn having vibrating ends, and a second cutting blade, wherein one of the vibrating ends of the second rod-shaped horn is connected to one of the vibrating faces of the ultrasonic horn and wherein the second cutting blade is connected to the vibrating end of the second rod-shaped horn which is not connected to the ultrasonic horn and is positioned in a plane transverse to the longitudinal axis of vibrations generated by the transducer.

7. An ultrasonic vibrating device according to claim 1 further comprising a second ultrasonic horn, identical to the first ultrasonic horn, connected to the transducer, parallel to the first ultrasonic horn, wherein the cutting blade has ends connected, respectively, to one of the vibrating faces of the first and second ultrasonic horns which is not connected to the transducer.

8. An ultrasonic vibrating device according to claim 2 further comprising a second ultrasonic horn, identical to the first ultrasonic horn, connected to the booster device, parallel to the first ultrasonic horn, wherein the cutting blade has ends connected, respectively, to one of the vibrating faces of the first and second ultrasonic horns which is not connected to the booster device.

9. An ultrasonic cutting device according to claim 1, 2 or 3 wherein the ultrasonic horn has four projections.

10. An ultrasonic cutting device according to claim 1, 2 or 3 wherein the blade is rectangular.

11. An ultrasonic cutting device according to claim 10 wherein the blade has a length of from 10 mm to 100 mm and a width of from 1 mm to 22 mm.

* * * * *

UNITED STATES PATENT AND TRADEMARK OFFICE

CERTIFICATE OF CORRECTION

PATENT NO. : 5,437,215

DATED : August 1, 1995

INVENTOR(S) : Francis F.H. RAWSON

It is certified that error appears in the above-indentified patent and that said Letters Patent is hereby corrected as shown below:

On the title page, item:

[19]," "Hamilton" should be --Rawson--.

Ur. Title page, item: "[75] Inventor:," "Francis F. Hamilton" should be --Francis F.H. Rawson--.

Signed and Sealed this

Thirteenth Day of August, 1996

Bruce Lehman

*Attest:*

BRUCE LEHMAN

*Attesting Officer*

*Commissioner of Patents and Trademarks*